United States Patent [19]

Vehling et al.

[11] Patent Number: 4,756,063

[45] Date of Patent: Jul. 12, 1988

[54] METHOD AND ARRANGEMENT FOR CRIMPING CABLES OF SYNTHETIC FIBERS

[75] Inventors: Ernst Vehling; Diethard Huebner, both of Bordesholm, Fed. Rep. of Germany

[73] Assignee: Neumuenstersche Maschinen- und Apparatebau GmbH, Neumuenster, Fed. Rep. of Germany

[21] Appl. No.: 942,886

[22] Filed: Dec. 15, 1986

Related U.S. Application Data

[63] Continuation of Ser. No. 783,752, Oct. 3, 1985, abandoned.

[30] Foreign Application Priority Data

Nov. 9, 1984 [DE] Fed. Rep. of Germany ..... 3440975

[51] Int. Cl.[4] ..... D02G 1/12

[52] U.S. Cl. ..... 28/269; 239/311

[58] Field of Search ..... 28/263, 268, 269; 239/311

[56] References Cited

U.S. PATENT DOCUMENTS

| | | | |
|---|---|---|---|
| 2,862,279 | 12/1958 | Fardon, Jr. et al. . | |
| 3,220,083 | 11/1965 | Crawford et al. | 28/269 |
| 3,491,420 | 1/1970 | Stanley | 28/269 X |
| 3,545,058 | 12/1970 | Stanley | 28/269 |
| 3,688,511 | 9/1972 | Harmstrof | 239/311 X |
| 4,006,861 | 2/1977 | Alger et al. | 239/311 |

FOREIGN PATENT DOCUMENTS

| | | |
|---|---|---|
| 1660637 | 1/1971 | Fed. Rep. of Germany . |
| 2222124 | 11/1973 | Fed. Rep. of Germany . |
| 3332387 | 3/1985 | Fed. Rep. of Germany . |
| 998343 | 7/1965 | United Kingdom . |

*Primary Examiner*—Robert R. Mackey

*Attorney, Agent, or Firm*—Michael J. Striker

[57] ABSTRACT

Crimping of cables of synthetic fiber is performed by an arrangement in which a cable is supplied by rotatable compression rolls with a high speed into a compression chamber, and a cooling air is supplied into the compression chamber, wherein water is added to the cooling air in form of fine droplets.

12 Claims, 2 Drawing Sheets

METHOD AND ARRANGEMENT FOR CRIMPING CABLES OF SYNTHETIC FIBERS

This is a continuation, of application Ser. No. 783,752, filed Oct. 3, 1985, now abandoned.

BACKGROUND OF THE INVENTION

The present invention relates to a method of and an arrangement for crimping of synthetic fibers, by means of rotatable compression rolls which supply a cable to a compression chamber with high speed, and wherein cooling air is blown into a housing which surrounds the compression rolls during operation.

Methods and arrangements of the above-mentioned general type are known in the art. In known methods and arrangements, a cable of freshly spun fibers of synthetic polymers is stretched in a continuous working process, is crimped in a compression chamber and subsequently cut to staple fibers. The crimping speed which is equal in conventional discontinuous processes to at most 100–150 m/min and does not exceed in practice 300 m/min must be naturally adjusted in a continuous process to the spinning speed and lies therefore always over 500 m/min, as a rule even over 1,000 m/min. With a typical spinning speed of 500 m/min and a stretching ratio of 1:4, a speed of 2,000 m/min is obtained for the stretched cable. With this speed, the cable is supplied to the crimping arrangement. At this speed the supply rolls of the crimping chamber, with the diameter of, for example, 120 mm, have a rotary speed of more than 5,000 rev/min. The modern developments have a tendency to have even higher speeds.

The given number of revolutions is counted from the condition that the surface speed of the rolls is equal to the supply speed of the cable. In contrast, the speed with which material moves forwardly in the compression chamber is considerably smaller. As a result of this, in addition to heat which is produced by the compression process, a friction heat takes place at the contact locations between the rolls and the material and it must be counted more and more with increasing speed. On the other hand, the cable whose temperature is increased by the produced heat, continuously withdraws heat. Computations and estimates show that the compression heat proper is withdraw at high speeds mainly through the cable, without exceeding the permissible value of its temperature. This is however no longer true to full extent for the above-mentioned friction heat. Cooling is required for this heat.

In the U.S. patent application Ser. No. 647,132, a crimping arrangement for high speeds is described, which is protected by a complete casing from outer influences. By blowing of cooling air into the housing, the temperature is easily controllable. The cooling air passes through the housing over a predetermined path and provides a uniformly maintained sufficient cooling. It has been shown, however, that air cooling is not sufficient in all cases to withdraw high friction heat.

The DE-OS No. 1,660,637 discloses a crimping arrangement in which additionally to a surface cooling, air provides an inner cooling of the compression rolls. It however requires conduits for supplying a cooling medium into the interior of the compression rolls, which is connected with especially complicated sealing problems in high speed crimping arrangements. It is structurally impossible to arrange cooling medium passages in the compression rolls. Since in contrast to the conventional crimping arrangements which operate with Titers up to 4 Mio Dtex, in the fast modern machines only Titers up to 200,000 Dtex take place, the compression rolls are correspondingly small and rather disc-shaped.

The U.S. Patent No. 2,862,279 discloses a crimping arrangement with a horizontal feed, in which water is supplied for cooling into the gap between the rotatable compression rolls and the fixed chamber walls. This arrangement can be used for the speeds of approximately 45 m/min or approximately 110 m/min when the water is sprayed with sufficiently high pressure. In the event of considerably higher speeds, no sufficient cooling can be obtained in this manner. The sprayed water is flung unused in its main part from the surfaces of the rolls. The water which is sprayed into the vent-shaped gap between the rolls and both horizontally arranged chamber walls is conveyed because of the high surface speed of the rolls from this gap and does not contact the cable. A further disadvantage is that it is necessary to provide a complicated arrangement of several nozzle pipes which partially must be provided at hardly accessible locations. Since there is always the danger that fine nozzle openings are clogged, it is very difficult to guarantee with this arrangement a uniform, finely dosed cooling.

SUMMARY OF THE INVENTION

Accordingly, it is an object of the present invention to provide a method of crimping cables of synthetic fibers in accordance with which an effective cooling is provided.

It is also an object of the present invention to provide an arrangement for crimping cables of synthetic fibers which provides an efficient cooling.

In keeping with these objects and with others which will become apparent hereinafter, one feature of the present invention resides, briefly stated, in a method of crimping cables of synthetic fibers in accordance with which a cable is supplied by means of rotatable compression rolls into a compression chamber with a high speed, a cooling air is blown into a housing which surrounds the compression rolls during operation, and fine water droplets are added to the cooling air so that the cooling air is supplied into the housing together with the fine water droplets.

In accordance with the inventive arrangement, means is provided for supplying cooling air into a housing which surrounds the compression rolls during operation, and further means is provided for adding water droplets to the cooling air so that the cooling air is supplied into the housing together with the water droplets.

When the method is performed and the arrangement is designed in accordance with the present invention, water droplets are entrained by the cooling air and applied to the points to be cooled. It has been shown from experiments that the required water quantity can be maintained so low that the cable is only slightly moisturized. This slight moisturizing is not only harmless, but has a surprising advantage: the preparation which adhered to the fibers and dried by the preceding contact with hot stretching rolls is moisturized and uniformly distributed, so that the cable is again very soft.

In accordance with another feature of the present invention, a preparation in quantity of maximum 5 percent is added to the water. It is recommended in the event of coarse individual Titers below somewhat 4 Dtex. With lower individual Titers, pure water is preferable, since the addition of preparation in such cases can lead to coaslescing.

Still another feature of the present invention is that distilled water can be used for forming the water droplets. In this case, formation of deposits is avoided. Because of amazingly low water consumption, the use of distilled water does not cause any significant cost increase.

Still a further feature of the present invention is that the cooling air and water supplying means are formed as an injector which has a mixing chamber communicating via narrow passages with an inlet pipe connected with a pressure air source and also a suction pipe which is connected with a water container and with the mixing chamber, wherein the mixing chamber is connected via a conduit with an inlet passage of the housing.

Finally, the axes of both compression rolls can lie in a horizontal plane, and the compression chamber can be arranged under the plane of the axes of the compression rolls. In this case the upper roll wedge serves as a trough in which a small water quantity is accumulated. Thereby the cable which is supplied from above is always moisturized uniformly, before it reaches the compression chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
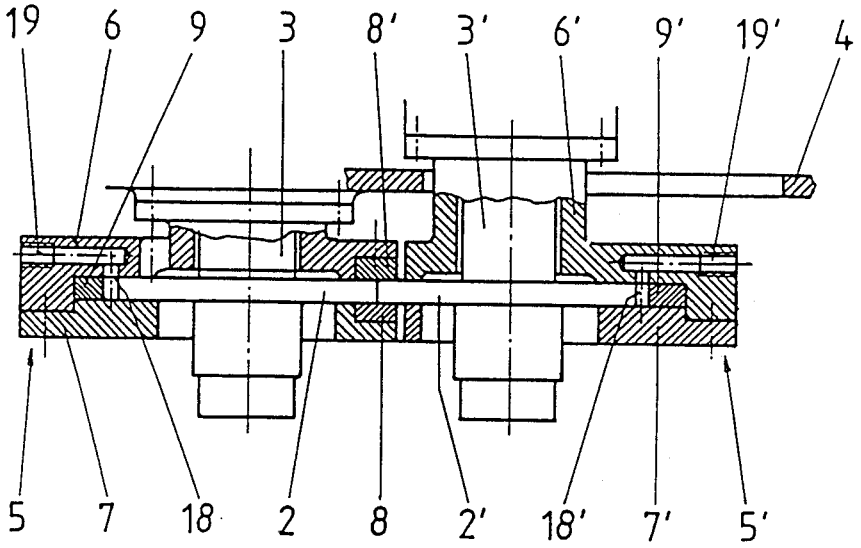
FIG. 2 is a horizontal section of the inventive arrangement in the plane of the axes of compression rolls; and axes of compression rolls.
Figure 3:
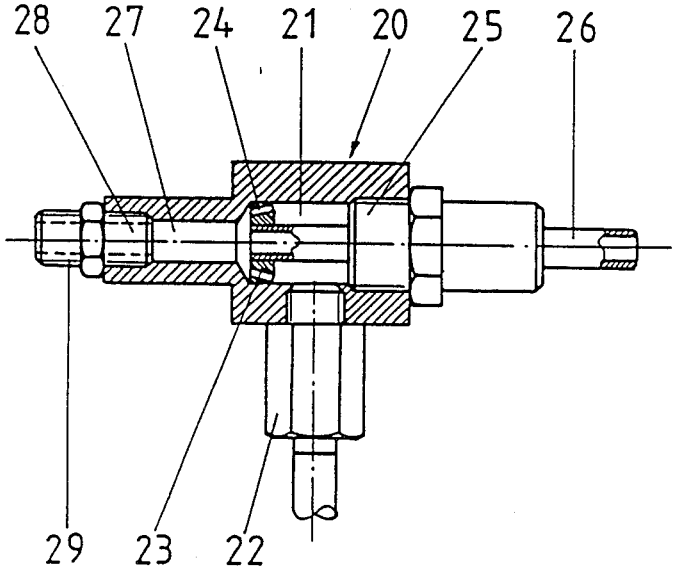
FIG. 3 is a view showing a fragment of the inventive arrangement on an enlarged scale.

An arrangement in accordance with the present invention has a compression chamber 1 which is associated with two small disc-shaped compression rolls 2 and 2'. The rolls 2 and 2' have axes which lie in a horizontal plane and are supported on shafts 3 and 3' floatingly on a machine frame. Only a front plate 4 of the machine frame is shown in FIG. 2. The bearings and the drive of the arrangement do not form a part of the present invention, therefore, are not described here in detail. They are described in the U.S. patent application Ser. No. 647,132 which is incorporated here as a whole by means of reference thereto.

Figure 1:
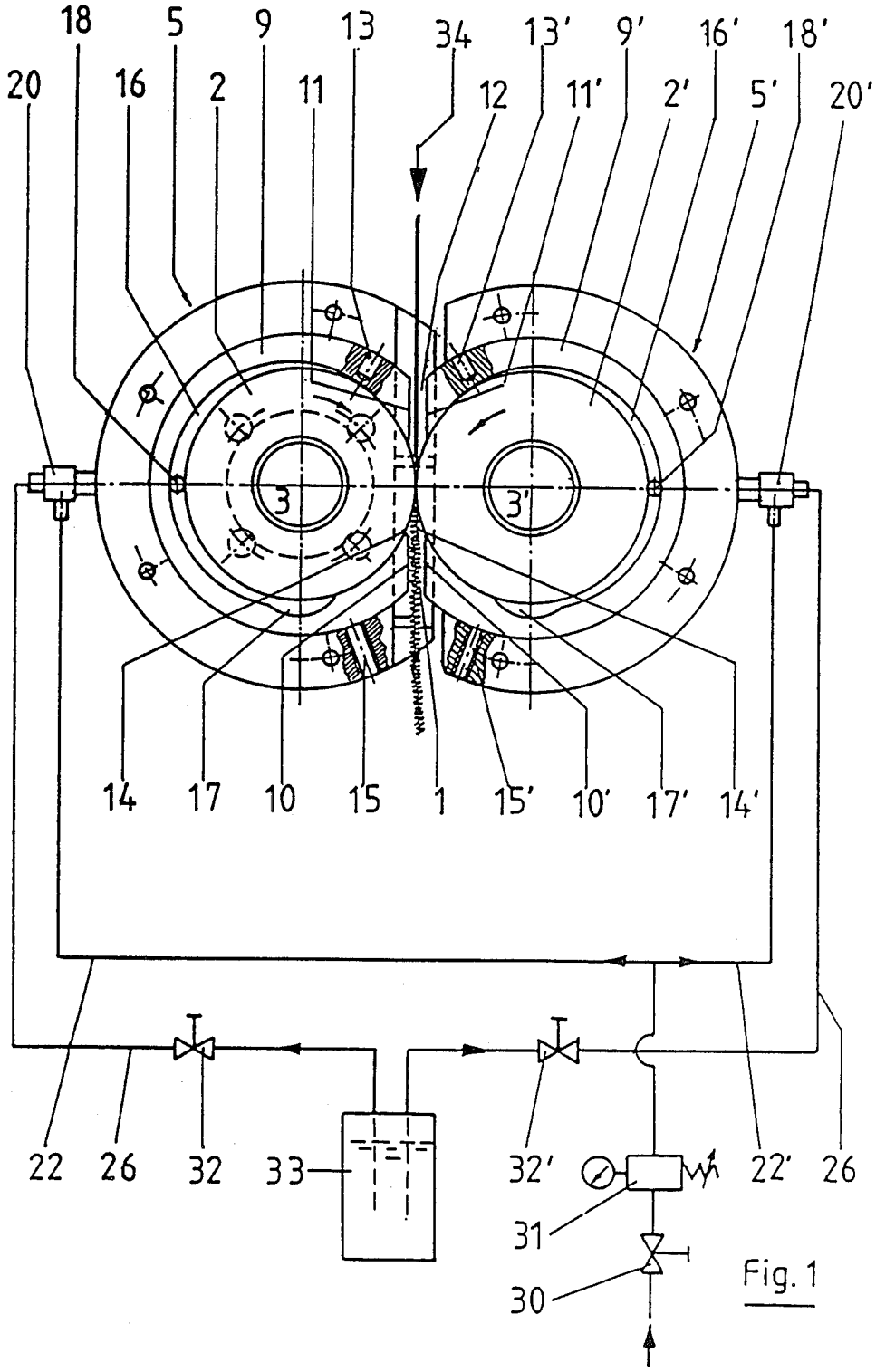
FIG. 1 is a side view of a crimping arrangement for cables of synthetic fibers in accordance with the present invention.

Both compression rolls 2 and 2' are seated in respective housing halves 5 and 5' which have the shape of a circle concentric to the respective pressure roll from which a segment is cut off along along a extending parallel to the plane of a roller gap. The housing halves 5 and 5' are asymmetrical relative to one another, so that their boundaries lie closer to the right compression roll 2' than the left compression roll 2, as shown in FIGS. 1 and 2. The compression roll 2' with the housing half 5' is displaceable relative to the compression roll 2 with the associated housing half 5, as described in the above-mentioned patent application. Each housing half 5 and 5' has a bottom 6 and 6', respectively, and a cover 7 and 7' respectively, fixedly screwed to the bottom. The bottom 6 is connected with a bearing bush of the shaft 3, while the bottom 6' is connected with a bearing bush of the shaft 3'.

Small side plates 8 and 8' of wear-resistant material are exchangeably inserted in the bottom 6 or the cover 7 of the housing half 5. They form a front and a rear limiting wall for the compression chamber 1. Intermediate pieces 9 and 9' formed as rings which are cut off along a chord are seated in concentrical recesses of the bottoms 6 and 6'. The intermediate pieces 9 and 9' have cut-off surfaces 10 and 10' which form lateral limits of the compression chamber 1 under the plane of the compression roll axes. Faces 11 and 11' located above this plane limit an inlet passage 12.

Because of an insignificant canting, the inlet passage 12 is somewhat wider than the compression chamber 1, and the compression chamber 1 reduces slightly in wedge-shaped manner downwardly. The wedge angle can be changed by insignificant rotation of the intermediate pieces 9 and 9' in the respective concentrical bottom recesses which form a guidance channel. Screws 13 and 13' which are accessible through slots in the edge of the bottoms 6 and 6' serve for arresting purposes.

The intermediate pieces 9 and 9' have eccentrical inner surfaces. Only a very small play remains between edges 14 and 14' of the intermediate pieces 9 and 9', and the outer surface of the associated compression rolls 2 and 2'. This play can be exactly adjusted by actuation of the screws 15 and 15'. In contrast, at the side which is opposite to the roll gap, relatively wider passages 16 and 16' are formed. Additional widenings 17 and 17' are provided under the axes of the compression rolls 2 and 2'.

The passages 16 and 16' are connected by short openings 18 and 18' with openings 19 and 19'. The openings 18 and 18' extend parallel to the axes of the compression rolls 2 and 2' and have a diameter of approximately 10 mm. The openings 19 and 19' form inlet passages for cooling air. The inlet passages 19 and 19' are provided with threads in which injectors 20 and 20' are screwed.

A ring-shaped air chamber 21 is formed in the interior of the injector 20. An air inlet pipe 22 opens laterally into the air chamber 21. The air chamber 21 is limited at its end side by a plate 23, which is provided with a ring of narrow openings 24 which are wind-tipped (skewed) to the axis of the injector. The other end side is closed by a plug 25 which is screwed into the injector. A suction pipe 26 extends centrally through the plug 25. The suction pipe 26 is seated with its one end in an opening of the plate 23 and opens, similarly to the openings 24, into a mixing chamber 27 which is coaxial with the air chamber 21. The mixing chamber 27 transits directly into a short conduit piece 28 which is screwed with its thread 29 into the inlet passage 19.

The air inlet pipe 22 is connected with a not shown pressure air source via a regulating valve 30 and an adjustable pressure reducer 31. The suction pipe 26 is connected with a water container 33 via a regulating valve 32.

The injector 20' corresponds to the injector 20, as shown in FIG. 1, and is provided with the respective pipe conduit.

In operation, the pressure air with maximum 6 bar positive pressure is supplied by the regulating valve 30 and the pressure reducer 31. It advances into the air chamber 21 and from there via the openings 24 advances with increased speed into the mixing chamber 27. The air stream which is strongly whirled by the wind-tipped arrangement of the openings 24 produces a negative pressure, so that water is aspirated via the suction pipe 26 from the container 33. The water quantity can be regulated by the valve 32. The aspirated water is whirled in the mixing chamber 27 with the air and forms fine droplets. The air enriched with water is supplied via the conduit piece 28, the inlet passage 19, and the wide opening 18 into the passage 16 and in the respective manner into the passage 16'. From there it flows through the narrow gap formed between the side surfaces of the compression rolls 2 and 2' and the respective housing walls. Entrained water droplets moisturize and cool the compression rolls and simultaneously act as a lubricant. One partial stream leaves the housing through the compression chamber 1 and permeates the material which is compressed there. Another partial stream discharges through the inlet passage 12 and acts directly upon the incoming cable. The upper wedge between both rolls acts as a trough in which a small water quantity is accumulated, so that the cable is always moisturized uniformly in the inlet. The water is practically completely evaporated, or in other words, high evaporation heat of the water is used for reduction of the process heat. This explains the high cooling action with simultaneous economical water consumption.

The example of the operation of the inventive arrangement and implementation of the inventive method is submitted hereinbelow.

EXAMPLE

A polypropylene fiber cable with Titer of between 6,000 and 20,000 Dtex is supplied in the direction of the arrow 34 vertically from above with a speed of 1,000 m/min to the arrangement in accordance with the present invention. The pressure air is supplied with a negative pressure of 2.0 bar, to the injectors. A water consumption is equal to 2–4 liter per hour.

It will be understood that each of the elements described above, or two or more together, may also find a useful application in other types of constructions differing from the types described above.

While the invention has been illustrated and described as embodied in an arrangement for crimping of cables of synthetic fibers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What we claim as new and desire to be protected by Letters Patent is set forth in the appended claims.

1. A method of crimping cables of synthetic fibers, comprising the steps of supplying a cable by means of rotatable compression rolls with a high speed into a compression chamber which is formed in a housing provided with an inlet opening; mixing a cooling air with water in a mixing chamber of an injector having an outlet opening so as to form a mixture of cooling air with fine water droplets, said mixing including supplying a cooling air to said mixing chamber in a predetermined direction through a central passage, and supplying cooling air to said mixing chamber through a plurality of passages arranged in a skewed manner relative to said central passage and to said direction, so that the air is whirled by the skewed passages and produces a negative pressure to aspirate the water from a water supply source; and blowing the cooling air with fine water droplets directly from the outlet opening of the injector into the inlet opening of the housing without supplying the same through intermediate passages, so as to finally flow into the compression chamber.

2. A method as defined in claim 1, and further comprising the step of adding preparation to the water in quantity of maximum 5%.

3. A method as defined in claim 1, wherein said mixing step includes using distilled water to add to the cooling air.

4. A method as defined in claim 1; and further comprising the step regulating the quantity of cooling air to be supplied to the mixing chamber.

5. A method as defined in claim 1; and further comprising the step of regulating the quantity of water to be supplied to said mixing chamber.

6. A method as defined in claim 1; and further comprising the step of regulating the quantity of cooling air and the quantity of water to be supplied to said mixing chamber.

7. An arrangement for crimping cables of synthetic fibers, comprising a housing provided with a compression chamber and an inlet opening; rotatable compression rolls arranged to supply a cable with a high speed into said compression chamber of said housing; and an injector having a mixing chamber in which cooling air is mixed with water to form a mixture of cooling air with fine water droplets, said injector having an outlet opening which is directly connected with said inlet opening of said housing without intermediate passages so as to blow the cooling air with water droplets directly into said housing, so as to finally flow into the compression chamber, said injector having a central passage through which water is supplied to said mixing chamber and a plurality of skewed passages which are inclined relative to said central passage for supplying cooling air into said mixing chamber, so that the air is whirled by the skewed passages and produces a negative pressure to aspirate the water from a water supply source.

8. An arrangement as defined in claim 7, wherein said injector has an inlet pipe arranged to communicate with a pressure air source and having an outlet which opens into said mixing chamber via narrow passages, and a suction pipe communicating said mixing chamber with a water source.

9. An arrangement as defined in claim 7, wherein said compression rolls have axes which lie in a horizontal plane, said compression chamber being arranged under said plane of said axes of said compression rolls.

10. An arrangement as defined in claim 7; and further comprising means for regulating the quantity of cooling air to be supplied to said mixing chamber.

11. An arrangement as defined in claim 7; and further comprising means for regulating the quantity of water to be supplied to said mixing chamber.

12. An arrangement as defined in claim 7; and further comprising means for regulating the quantity of cooling air and the quantity of water to be supplied to said cooling chamber.

* * * * *